US007070023B2

(12) United States Patent
Waxler

(10) Patent No.: US 7,070,023 B2
(45) Date of Patent: Jul. 4, 2006

(54) ADJUSTABLE STILT

(76) Inventor: Denny Waxler, #2 Keywish Dr., Belton, TX (US) 76513

( * ) Notice: Subject to any disclaimer, the term of this patent is extended or adjusted under 35 U.S.C. 154(b) by 281 days.

(21) Appl. No.: 10/700,935

(22) Filed: Nov. 4, 2003

(65) Prior Publication Data

US 2005/0092552 A1 May 5, 2005

(51) Int. Cl.
*E04G 3/00* (2006.01)
*A61F 2/60* (2006.01)
*A43B 3/10* (2006.01)

(52) U.S. Cl. ..... 182/230; 182/129; 623/29; 36/7.5

(58) Field of Classification Search ..... 182/129, 182/230, 200, 45; 623/28, 29; 36/7.5, 81; 248/243, 295.11
See application file for complete search history.

(56) References Cited

U.S. PATENT DOCUMENTS 2,899,685 A * 8/1959 De Carbon ..... 623/28
2,923,947 A * 2/1960 Weighill ..... 623/28
3,454,965 A * 7/1969 Kenworthy et al. ..... 623/28
3,595,339 A 7/1971 Ballard
3,626,609 A * 12/1971 Cramer ..... 36/7.5
3,735,980 A * 5/1973 Weiss ..... 482/75
3,758,891 A * 9/1973 Geister ..... 623/29
4,415,063 A 11/1983 Hutchison
5,593,373 A 1/1997 Hale
6,105,718 A * 8/2000 Stewart ..... 182/45
6,964,634 B1 * 11/2005 Wojtkiewicz et al. ..... 482/77

FOREIGN PATENT DOCUMENTS

DE 3507741 A1 * 1/1986

* cited by examiner

*Primary Examiner*—Hugh B. Thompson, II
(74) *Attorney, Agent, or Firm*—Marcus Hammack

(57) ABSTRACT

A stilt assembly with interchangeable sections for varying the height thereof. A base assembly, middle assembly and foot support assembly include puzzle registries which allow for the stilt to be assembled with two assemblies (base and foot support assemblies only) for a shorter configuration, or with three assemblies (base, middle, and foot support assemblies) for a taller configuration. A foam spacer block provides height spacing in at least one assembly, and provide shock absorption and fail-safe height support, without failure-prone mechanical mechanisms.

2 Claims, 1 Drawing Sheet

ADJUSTABLE STILT

BACKGROUND OF THE INVENTION

1. Field of the Invention

The present invention relates to height adjustable stilts in workplace and recreation contexts.

2. Background Information

Many construction activities, such as painting, wallpapering, ceiling texturing, etc., require work performance at heights not reachable by typical workers. Additionally, many professional and recreational activities, such as circus clowns, etc., require performance at elevated heights. In both contexts, professionals and amateurs have struggled with achieving performance at heights unreachable by the person alone. Several methods have been devised to elevate persons from the floor or ground. The problem has been to develop equipment that allows for easy horizontal movement (i.e. walking), is height adjustable, is completely secure in its height adjustment so as to not be vulnerable to catastrophic failures resulting in sudden drop of height, leaves the hands and body free to work, provides stability on flat to moderately rough surfaces, provides shock absorption during movement, is light weight, is portable, fastens securely to the user, is reasonably convenient to mount and dismount, and is cost effective.

Achieving all of the desired aspects in one set of stilts is a difficult task at best. Thus, current solutions typically tradeoff some requirements in favor of others. However, the need for a design that addresses the safety issue of sudden catastrophic drops in height, shock absorption, and the relation of these requirements to cost has gone unfulfilled.

The present invention, as will be described below, incorporates the fact that many amateurs and professionals will not spend large sums of money for the currently available adjust-on-the-fly stilts commonly used by professionals. This is especially true since many users may only need one height setting to be used for extended periods and thus, have no need for the costly option of immediate on-the-fly height adjustment. Additionally, the present invention provides a level of shock absorption for the user, which is an important comfort aspect for users who spend large amounts of time on stilts. Furthermore, the present invention solves the safety problem of failures of elevation mechanisms resulting in sudden catastrophic drops in height and potential injury to the user.

SUMMARY OF THE INVENTION

In view of the foregoing, it is an object of the present invention to provide an improved method for mobile height elevation by way of stilts.

It is another object of the present invention to provide a novel means of stilt height adjustment for the user without the use of costly on-the-fly height adjustment mechanisms.

It is another object of the present invention to provide an improved method of shock absorption on mobile stilts.

It is another object of the present invention to provide a novel means for eliminating the risk of sudden catastrophic drops in height from height adjustable stilts.

In satisfaction of these and other related objectives, Applicant's present invention provides for improved height adjustable stilts. Applicant's stilt, in its preferred embodiment, exhibits a base assembly with a base plate with traction surface on the bottom-most position of the assembly. The upper surface of the base assembly includes puzzle piece-like recesses (or protrusions, depending on the manufacturer's preferences) which are designed to reversibly register with a base plate portion which is configured of either a middle, I-beam assembly (used to configure the stilt for effecting the greatest height increase for its user), or a foot support assembly (connected directly to the base assembly, when a shorter configuration is desired). The foot support assembly includes a spacer block which is, in the preferred embodiment, made of a dense, shock absorbing foam material, on top of which is a top plate with a foot engagement assembly with suitable straps (VELCRO) for securing one's foot, shoe or boot in position atop the stilt assembly.

The three assemblies of the preferred embodiment just described interlock in the two described configuration, and may be substituted or supplemented with additional assemblies of differing heights to provide an even greater variety of height options. Equivalent to the present disclosure are units in which the I-beam (or its equivalent) and the foam block are exchanged in relative positions.

The foam blocks of the foot assembly provide stability and shock absorption for the stilts. Furthermore, by varying the material used for the foam blocks, different levels of shock absorption can be set by the user.

Applicant's approach to the problem described above is certainly simple, but it is equally unobvious. Applicant's informal surveys of professional and amateur stilt users reveal a long but unsatisfied need for height adjustable stilts that are less expensive than the costly adjust on-the-fly stilts, have no safety risk of sudden catastrophic height drops, and provide variable shock absorption. Despite this well-known and long-existing problem, no one has presented a viable, cost effective solution such as applicant here provides.

DETAILED DESCRIPTION OF THE PREFERRED EMBODIMENT

Figure 1:
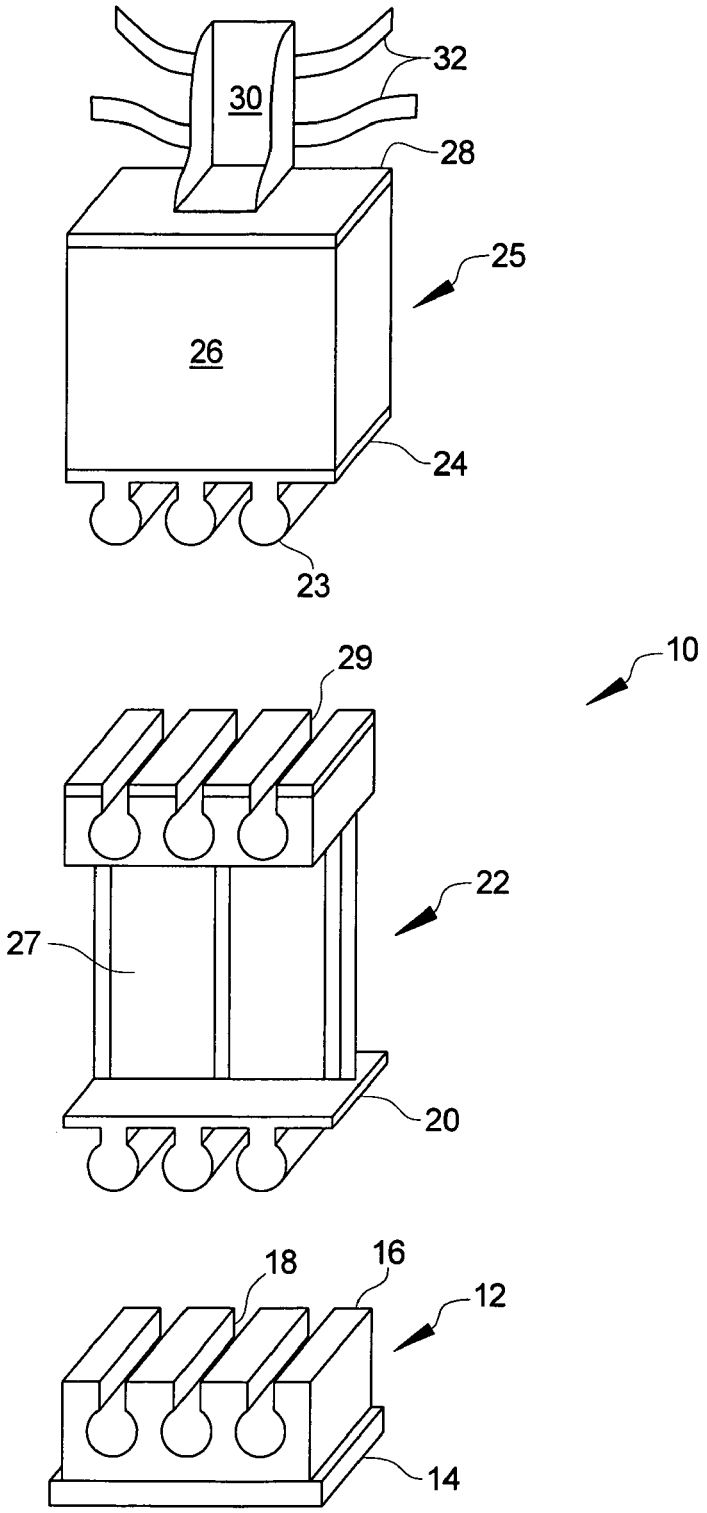
FIG. 1 is a rear, elevational, exploded view of a stilt assembly of the present invention.

With reference to FIG. 1, the stilt assembly of the present invention is identified generally by the reference number 10.

Stilt assembly 10 includes a base assembly 12 with a base plate 14 having a traction surface (not visible in the drawing) on the bottom most position of the base assembly 12. The upper surface 16 of base assembly 12 includes puzzle registry 18 which is designed to reversibly register with a complementarity configured based plate portion 20 of a middle assembly 22 (used to configure the stilt for effecting the greatest height increase for its user), or with a puzzle registry 23 of a base plate assembly 24 of a foot support assembly 25 (connected directly to the base assembly 12, when a shorter configuration is desired).

In the preferred embodiment, middle assembly 22 includes a plastic I-beam 27 which provides the height of middle assembly 22. A plastic I-beam structure is chosen for lightness and in view of cost considerations, but alternative spacing material and configurations are acceptable, and within the scope of the present invention.

The foot support assembly 25 includes a foam spacer block 26 which is, in the preferred embodiment, made of a dense, shock absorbing foam material (available from sources such as the Minnesota Mining and Manufacturing Company), on top of which is a top place 28 with a foot engagement assembly 30, in turn, with suitable straps 32 (VELCRO) for securing one's foot, shoe or boot in position atop the stilt assembly 10.

The puzzle registry 23 of base plate 24 of foot support assembly 25 is configured to reversibly engage, alternatively, with either puzzle registry 18 of base assembly 12 or with puzzle registry 29 which is situated atop I-beam member 27 of middle assembly 22.

The three assemblies of the preferred embodiment just described interlock in the two described configuration (taller or shorter configuration, respectively with and without the middle, I-beam assembly 22), and certain of the described assemblies, or components thereof, may be substituted or supplemented with additional assemblies of differing heights to provide an even greater variety of height options. Equivalent to the present disclosure are units in which the I-beam (or its equivalent) and the foam block are exchanges in relative positions, as well as units in which the puzzle assemblies are respectively reversed in the their male/female configuration as shown.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. A stilt assembly comprising:

a base assembly with a floor engaging surface on a first side and a first puzzle registry on a second, opposite side;

a middle assembly having a second puzzle registry on a first middle assembly terminal end, and a third puzzle registry on a second middle assembly terminal end, said second puzzle registry being configured for engagement with said first puzzle registry of said base assembly; and a foot support assembly having a fourth puzzle registry on a first foot support assembly terminal end, and a foot engagement assembly supported at a second foot support assembly terminal end, said foot support assembly having a foam spacer block member situated between said first foot support assembly terminal end and said second foot support assembly terminal end, said fourth puzzle registry being configured for engagement with said first puzzle registry and said third puzzle registry alternatively.

2. A stilt assembly comprising:

a base assembly with a floor engaging surface on a first side and a first puzzle registry on a second, opposite side;

a middle assembly having a second puzzle registry on a first middle assembly terminal end, and a third puzzle registry on a second middle assembly terminal end, said middle assembly having a foam spacer block member situated between said first middle assembly terminal end and said second middle assembly terminal end, said second puzzle registry being configured for engagement with said first puzzle registry of said base assembly; and a foot support assembly having a fourth puzzle registry on a first foot support assembly terminal end, and a foot engagement assembly supported at a second foot support assembly terminal end, said fourth puzzle registry being configured for engagement with said first puzzle registry and said third puzzle registry alternatively.

* * * * *